United States Patent [19]

Milgram, Jr. et al.

[11] Patent Number: 5,021,116

[45] Date of Patent: Jun. 4, 1991

[54] LABELING MACHINE

[75] Inventors: Joseph B. Milgram, Jr.; P. Clark Hungerford, Jr., both of Cleveland Heights, Ohio

[73] Assignee: Aexcel Corporation, Willoughby, Ohio

[21] Appl. No.: 220,500

[22] Filed: Jul. 18, 1988

[51] Int. Cl.[5] ..... B65C 31/00

[52] U.S. Cl. ..... 156/475; 156/492; 156/493; 156/571

[58] Field of Search ..... 156/475, 477.1, 478, 156/479, 481, 486, 489–493, 566, 567, 570–572

[56] References Cited

U.S. PATENT DOCUMENTS

| | | | |
|---|---|---|---|
| 1,856,576 | 5/1932 | Maxwell . | |
| 2,284,019 | 5/1942 | Powell . | |
| 3,206,347 | 9/1965 | Holstein | 156/492 X |
| 3,206,348 | 9/1965 | Holstein | 156/492 |
| 3,306,803 | 2/1967 | Holstein | 156/570 X |
| 3,673,043 | 6/1972 | Carter . | |
| 4,172,753 | 10/1979 | Benoit | 156/566 X |
| 4,316,762 | 2/1982 | Martin . | |
| 4,324,608 | 4/1982 | Klinger . | |
| 4,504,336 | 3/1985 | Talalay | 156/492 X |

FOREIGN PATENT DOCUMENTS

| | | |
|---|---|---|
| 334636 | 10/1930 | United Kingdom . |
| 853424 | 11/1960 | United Kingdom . |

OTHER PUBLICATIONS

Pail Labeler Brochure published by Anker Labelers Corp.

*Primary Examiner*—David A. Simmons

*Attorney, Agent, or Firm*—Watts, Hoffmann, Fisher & Heinke Co.

[57] ABSTRACT

A labeling apparatus for applying adhesive backed labels to containers or the like. A transverse conveyor transports a label to be applied from a feeder to a label presenting position on the conveyor. A label applying head including a pair of pivotally mounted arms and an elastic, label support belt stretched between distal ends of said arms, is rotated to a label applying position at which said support belt is positioned in a confronting relation with said label. A label pickup member forming part of said head is communicated with a source of vacuum to create a suction force at apertures formed in the member and engages the label and holds it to the head. A fluid pressure operated swing actuator rotates the label applying head to a label applying position and a wrap actuator is activated to drive the label support belt into wrapping engagement with an exterior surface of the container being labeled, thereby transferring the label from the support belt to the container. A fluid pressure operated control system controls movement in the conveyor and the label applying head.

31 Claims, 4 Drawing Sheets

DRIVE MOTOR
247
246
SUPPLY (IN)
SET
RESET
222
SET
220
SUPPLY (OUT)
SUPPLY (IN)
MEM
300
SET
SET
MEM
SUPPLY (OUT)
313
270
204b
223
208
SUPPLY (IN)
DELAY
316
MEM
NOT
SET
LV5
332
AND
240
266
264
262
LOW PRESSURE
262a
242
244
216
218
206
204
204a
200
202
DELAY
328
280
284
310
320
330
268
4
5

LABELING MACHINE

TECHNICAL FIELD

The present invention relates generally to labeling methods and apparatus and in particular to a method and apparatus for applying labels to containers such as cans, bottles, pails and other similarly shaped articles.

BACKGROUND ART

Automated and semi-automated methods and apparatus for applying a label to a container have been developed and/or suggested in the past. Machines for automatically applying adhesive-backed labels to cylindrical containers such as pails, cans and bottles are commercially available. Many if not most of these machines are intended for high production applications and as a result, the cost for setting up the machine to apply a specific label to a specific type of container can be time consuming and costly. If the shape or size of the container and/or the label changes, the set up procedure must once again be performed, necessitating machine down time and attendant expense. Once set up, current machines will generally accommodate only one-size label and/or one-size container and substantial readjustments must be made in order to perform the labeling operation on a differently sized or shaped container.

DISCLOSURE OF THE INVENTION

The present invention provides a new and improved method and apparatus for applYing adhesive labels to containers and packages including pails, bottles, boxes and cans. The apparatus can accommodate a variety of label sizes and container sizes without requiring extensive modification or set up time. In the preferred embodiment, the apparatus is especially adapted to handle short-run labeling functions and allows the user to switch labels and/or container sizes/configurations in a quick and efficient manner. In addition, the machine is readily movable so that it can be used in various locations in a plant to apply a variety of labels to various sized containers. With the disclosed invention, a single labeling machine can be used to label diverse containers located in diverse locations in a plant.

According to the invention, the labeling apparatus includes a device for positioning a label at a label presenting position. In the preferred and illustrated embodiment, the device comprises a transfer conveyor. A label applying head forming part of the labeling machine is movable between label receiving and label applying positions. The label applying head includes a pair of arcuate arms, pivotally attached at one end to the head such that distal ends of the arms are reciprocally movable towards and away from each other. An elastic label applying belt is supported between the distal ends of the arms. The label applying head includes a label holding member which is operative to engage a label presented by the label conveyor and is further operative to maintain engagement with the label as the label applying belt is driven into engagement with a container. The engagement causes the label to be transferred from the belt to the container.

In accordance with one preferred embodiment, a label to be applied to a container is transported to the label presenting position by a conveying arrangement that includes one or more transversely spaced conveyor belts such as timing belts. The label to be applied is driven onto the conveyor by at least one pinch roll assembly that is commonly driven with the conveyor so that their speeds are synchronized.

When the label reaches a label presenting position on the conveyor, the label applying head engages the label and lifts it off the conveyor. In particular, the label applying head is rotated until the label wrapping belt is positioned in a confronting relation with the conveyor support belts.

When the label reaches the predetermined label presenting position, belt support arms move towards the conveyor so that the belt and a label gripping member forming part of the head engage the label supported on the conveyor. In the illustrated embodiment, the label gripping member is vacuum operated and is communicated with a source of vacuum. The vacuum operated label holding member is activated and grips the label, holding it to the label applying head.

The label applying head is rotated until it is in a spaced, confronting relation with the container to be labeled and is then moved into contact with the container so that the label is pressed into abutting contact with at least a portion of an external surface of the container. An adhesive (applied to the label by a gluing unit or other apparatus prior to the label being fed onto the conveyor) bonds the label to the container. The label holding member forming part of the head is de-energized to release the labels and the labeling head is retracted leaving the label on the container. The labeling head is returned to the label presenting position whereupon the cycle is repeated.

The disclosed label applying apparatus can be used in connection with a container feed conveyor so that during loading of the label, the next container to be labeled can be advanced to the label applying position.

According to a feature of the invention, the label gripping member forming part of the labeling head comprises a flexible conduit having a plurality of apertures. When the label is to be engaged, the source of vacuum is energized to evacuate the inside of the conduit creating sub-atmospheric regions at each aperture. The vacuum generates a gripping force which attracts the label and holds it to the conduit.

In the preferred and illustrated embodiment, the conduit is elastic and is co-extensive with the elastic belt and is positioned along one longitudinal edge of the belt with the apertures in the member being substantially flush with the belt. With the disclosed embodiment, the holding member is also wrapped around the container during the label applying step.

According to the invention, the arms that support the elastic belt are moved between the retracted and extended positions by a fluid pressure operated actuator. According to the preferred method of operation, the arms are fully retracted by the actuator in order to enable rotation of the labeling head to a position at which the belt is located in confronting relation with the label support belts forming part of the conveyor. Once in position, the actuator is de-energized to allow gravity to pull the arms towards the support belts thereby causing the label applying belt and the label gripping member to contact the label located at the label presenting position on the conveyor.

Prior to swinging the labeling head to the label applying position, the actuator is again energized to fully retract the arms to provide clearance as the head rotates from the label receiving position to the label applying position. After reaching the label applying position, the actuator is energized to move the arms towards each other thereby causing the engagement of the elastic belt and label pick up tube with the container.

According to a feature of the invention, prior to moving the arms into engagement with the container, the entire labeling head is moved substantially rectilinearly towards the container preferably until a center portion of the elastic belt is close to or in slight contact with the periphery of the container to be labeled.

According to another feature of the invention, fluid pressure, preferably pneumatically operated, actuators are used to achieve the various movements in the label applying apparatus. Synchronization and control of the actuators is preferably provided by a fluid logic system. With the disclosed actuators and control, the labeling apparatus can be used in an explosive environment because the risk of sparks is minimized.

According to another feature of the invention, a label feeder is provided for sequentially feeding labels from a supply into the conveyor apparatus. In accordance with this feature, an adhesive applying unit is provided between the feeder and the label conveyor and is operative to apply adhesive to portions of the label. In the preferred embodiment, the adhesive is applied to the label in regions not contacted by the support belts that form part of the label support conveyor.

The present invention provides a relatively inexpensive labeling apparatus that unlike many prior art machines, can be used to apply a variety of labels to a variety of containers without requiring substantial readjustment or set-up. In addition, the disclosed apparatus can be used to apply very large labels to containers or packages, a function that many prior art machines are not capable of doing well or at all. Although the disclosed machine can be used for long-run operations, it can also be used economically for relative short-run applications since set-up and adjustment time to accommodate different size containers and/or labels is minimized, if not eliminated.

The use of an elastic belt to press the label against the container provides an important feature of the invention. Firstly, the belt can easily accommodate a variety of container sizes and configurations. Secondly, during the application process, the belt tends to smooth out the label being applied and reduces or eliminates the incidence of wrinkling.

When the disclosed apparatus is used to apply labels to cylindrical containers, the label applying belt tends to "wrap" around the periphery of the container. In normal operation, a center region of the belt contacts the container first. The remaining portions of the belt then gradually contact the container thus gradually applying the label. As a result, the belt tends to smoothen out the label and compensates for slight surface/shape irregularities in the container. When used in this labelling application, the label holding member also wraps around the cylindrical container during label application.

According to still another feature of the invention, the mechanism for swinging the labeling head includes an actuator driven rack/gear mechanism. With this disclosed construction, the label applying position to which the head is rotated is easily adjusted by controlling the stroke of the actuator and/or by using mechanical stops to block movement in the gear and/or rack. This feature allows the labelling head to move to an angled position with respect to the container and thus facilitates the application of labels to tapered containers.

Additional features of the invention will become apparent and a fuller understanding obtained by reading the following detailed description made in connection with the accompanying drawings.

BEST MODE FOR CARRYING OUT THE INVENTION

Figure 1:
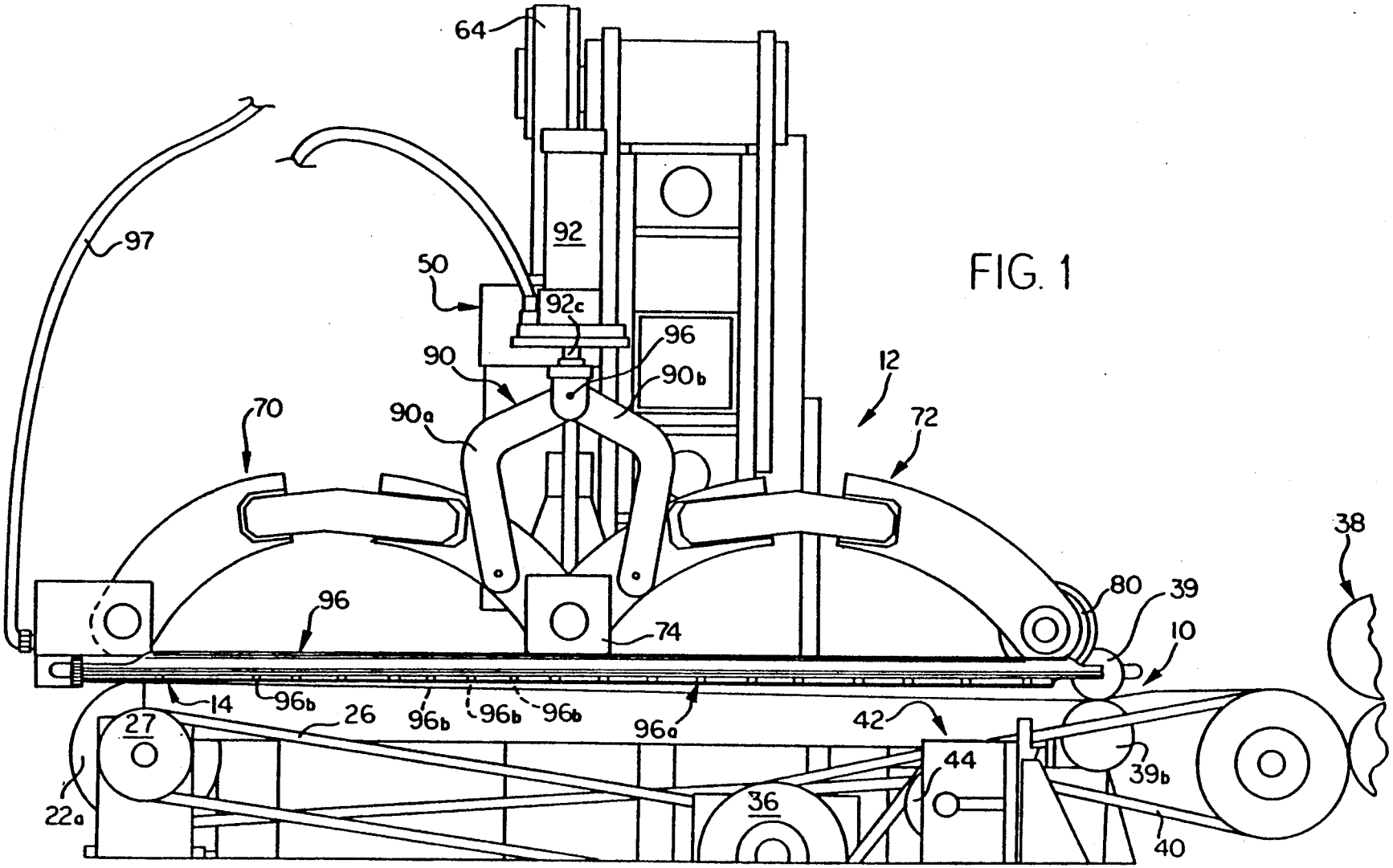
FIG. 1 is a side elevational view of a label applying apparatus embodying the present invention.

FIG. 1 illustrates the overall construction of a labeling apparatus constructed in accordance with the preferred embodiment of the invention. The labeling apparatus includes a horizontal conveyor indicated generally by the reference character 10 and a label applying head indicated generally by the reference character 12 which is operative to engage a label carried by the conveyor 10 and apply the label to a container 14 (shown in FIG. 3).

Figure 2:
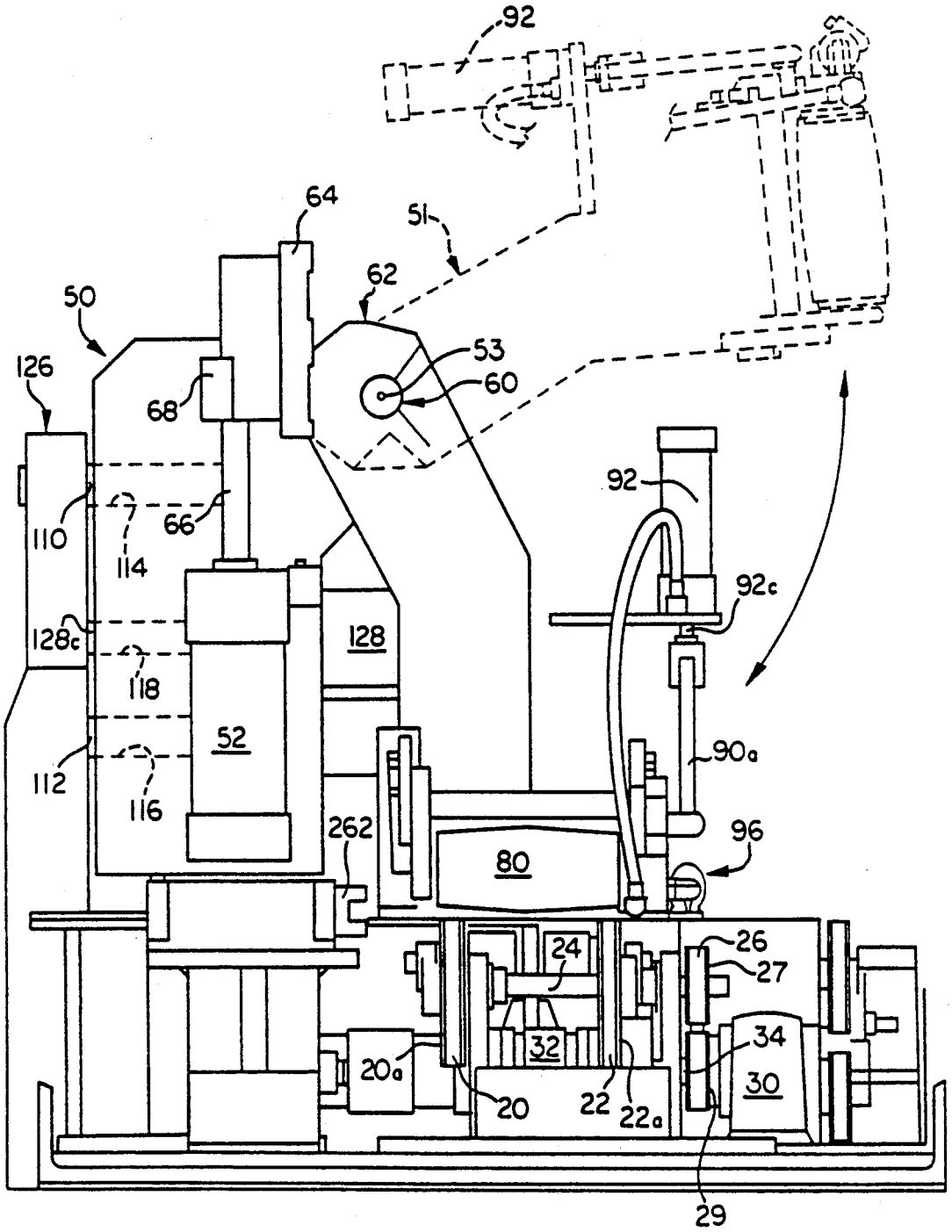
FIG. 2 is a left, side elevational view of the apparatus shown in FIG. 1.

Referring also to FIG. 2, the horizontal conveyor 10 includes a pair of support belts 20, 22 (shown best in FIG. 2) which are reeved around drive pulleys 20*a*, 22*a* respectively, co-driven by a common shaft 24. The belts 20, 22 are preferably timing belts so that slippage between the belts and the drive pulleys 20*a*, 22*a* is resisted. The shaft 24 is driven by a V-belt 26 and pulley 27 which are driven from a pillow block 30 that includes an inner drive pulley 29. A drive motor, preferably a pneumatic gear motor 32 serves as a main drive and is connected to the pillow block via a shaft 34. A pulley 36 mounted on the opposite side of the pillow block 30 drives a gluing attachment, indicated generally by the reference character 38, (which may be of conventional design), through a V-belt 40. A tension arrangement 42, including a movable pulley 44 is used to adjust the tension in the belt 40.

A pinch roll 39 is driven by the conveyor. In particular, the pinch roll 39 is frictionally driven by the belts 20, 22. The nip defined between the pinch roll 39 and the conveyor belts 20,22 receives the label as it leaves the gluing unit 38 and feeds it onto the conveyor. When the drive motor 32 is activated, the conveyor 10, the pinch roll 39 and the gluing attachment 38 are driven in synchronization so that a label leaving the gluer is fed onto the conveyor 10 at a speed matching the linear speed of the support belts 20, 22.

Figure 3:
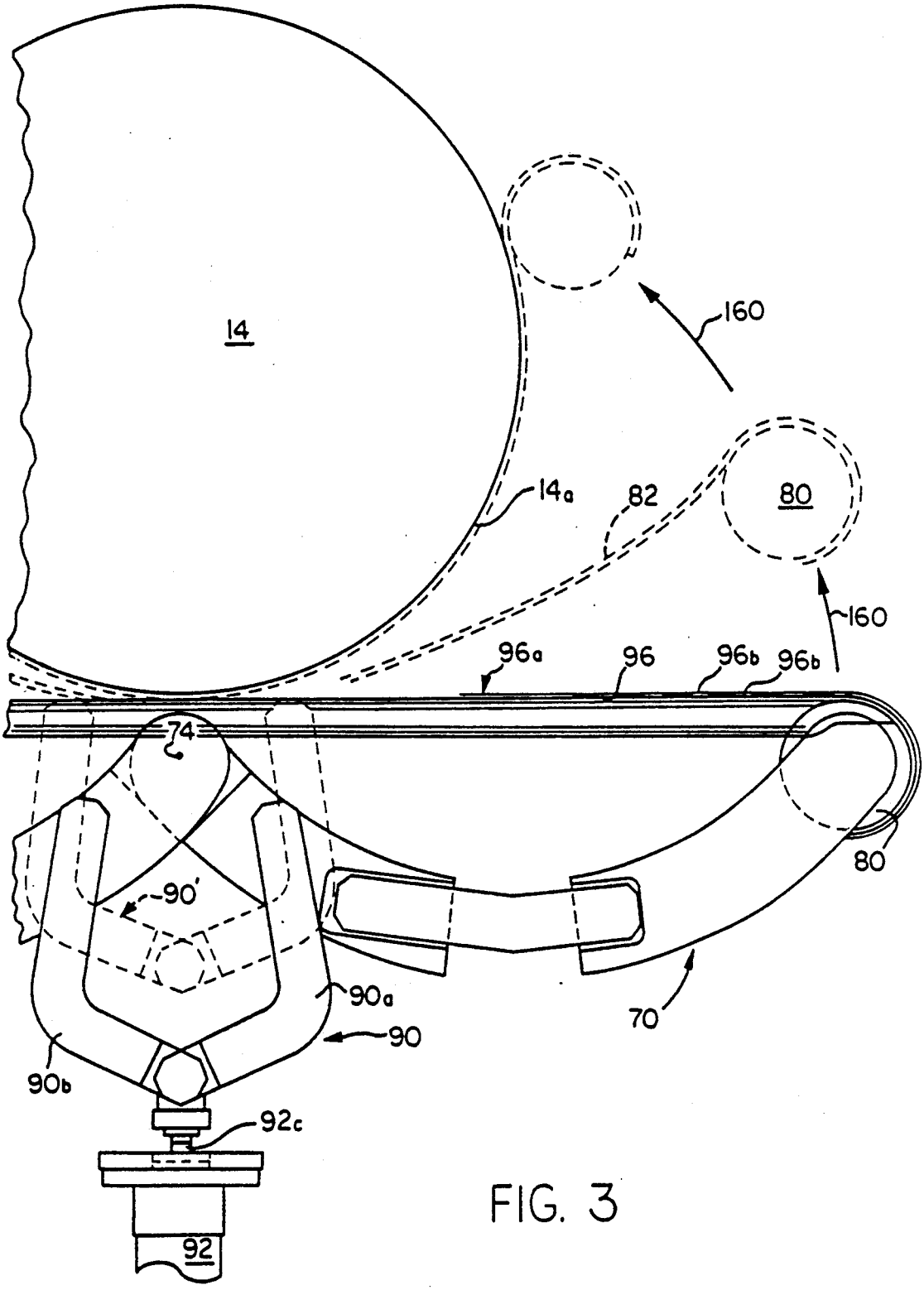
FIG. 3 is a fragmentary, planned view of the apparatus shown in FIG. 1; and, FIG. 4 is a schematic of a fluid logic control system constructed in accordance with a preferred embodiment of the invention.

The labeling head 12 is operative to pick up a label from the conveyor belts 20, 22 and press it into overlying engagement with the container 14 being labeled. Referring to FIGS. 1–3, the label applying head 12 is mounted to a support tower indicated generally by the reference character 50. As seen in FIG. 2 the head 12 is pivotally movable about a transverse axis 53, between a label engaging position indicated in solid line and a label applying position 51 indicated in phantom. The tower 50 mounts an actuator 52 which drives the labeling head 12 between the label receiving and label applying positions. In particular, the labeling head is pivotally attached to the tower 50 by a pin arrangement 60. A gear 62 is connected to the labeling head 12 and is in turn engaged by a rack 64. The rack 64 is connected to an actuating rod 66 forming part of the actuator. Vertical, reciprocating motion of the rack 64 causes rotative movement in the head 12. A guide block 68 captures and provides a thrust surface for the rack 64.

According to the invention, the extended position of the actuator 52 is adjustable. The final extended position determines the angle of the support belt 82 with respect to the vertical. With the present invention, extended position can be adjusted to define a slight angle with the vertical (as shown in FIG. 2 in order to accommodate a container having a tapered sidewall. By applying the label at a slight angle, wrinkling is reduced and the application of the label is enhanced. The extended position con be controlled or adjusted by controlling the stroke of the actuator 52 using known methods. Alternately, adjustable mechanical stops can be employed to block movement in the rack gear 62 or the rack 64 to define the raised position of the labeling head 12.

The labeling head 12 includes a pair of arcuate arms 70, 72. The arms 70, 72 are pivotally connected to a pivot assembly 74. Fixed, roller-like mounting members 80 are mounted at the distal ends of each pair of arms 70, 72. A label wrapping belt 82 is suitably attached to, and stretched between, the mounting members 80. The use of an elastic belt enables the arms 70, 72 to move through a range of positions while still maintaining tension in the belt. In addition, the use of an elastic belt enables the head to accommodate a variety of container sizes and configurations and also tends to smooth the label during the application process.

Movement in the arms 70, 72 is controlled by a yoke 90 and a fluid pressure operated label wrapping actuator 92. The yoke 90 includes a pair of curved levers **90*a*, 90*b* pivotally connected at their upper ends at a common pivot 96 located at the end of an actuating rod 92*c* forming part of the actuator 92. The opposite ends of the yoke levers 90*a*, 90*b* are pivotally connected to respective arms 70, 72. When the actuator is retracted the arms 70, 72 are moved to their "wide open" position at which the arms are fully spread apart. When the actuator is extended, the distal ends of the arms 70, 72 move towards each other, pivoting about the pivot 74**.

According to the invention, a label to be applied is moved along the lower conveyor 10 (defined by the support belts 20, 22) until it is in a predetermined position with respect to the labelling head 12. When it reaches the predetermined position, the drive motor 32 is de-energized to terminate further movement. The actuator 92 is then depressurized allowing the arms 70, 72 to fall downwardly under their own weight. The label wrapping belt abutably contacts the label.

A label pickup member 96 (only a portion of the member is shown in FIG. 1) forms part of the labeling head 12. In the preferred embodiment, the label pick up member 96 comprises an elastomeric tube or conduit that extends and is stretched between the distal ends of the arms 70, 72. The tube preferably includes a relatively flat portion that defines a substantially planar contact or gripping surface **96*a*. The tube 96 includes a plurality of apertures 96*b* located substantially in a plane coincident with the plane defined by the wrapping belt 82 and extending through the planar portion 96*a*** and communicating with an inner longitudinal passage.

When a label is to be gripped by the labeling head 12, the tube 96 is communicated with a vacuum source (via vacuum conduit 97) so that a low pressure region is defined at each aperture **96*b*. The resulting suction attracts the label and clamps it to the label pickup or holding member 96. As long as the vacuum is maintained, the label is held to the labeling head so that the label will be carried with the labeling head 12** when it's moved to the label applying position.

After the label is engaged by the pick up 96, the actuator 92 is again pressurized to fully retract the actuating rod **92*c* and hence pull the arcuate arms 70, 72 upwardly to their retracted positions at which the distal ends are spaced above the lower conveyor 10. This is done in order to provide clearance between the label wrapping belt 82 and the lower conveyor 10 as the labeling head 12 is rotated upwardly to the label applying position 51**.

Referring to FIG. 2, after the labeling head 12 reaches the label applying position 51 (shown in phantom), the entire labeling head 12 is moved rightwardly (as viewed in FIG. 2) until a portion, preferably the central region, of the label wrapping belt is in abutting contact or near abutting contact with the container 14 to be labeled (shown best in FIG. 3). This is achieved by a slide arrangement that includes a pair of shafts 110, 112 that extend horizontally and are fixed to a vertical support member 126 forming part of a frame of the machine. The tower 50 includes bores 114, 116 which slidably receive the slide shafts 110, 112, respectively. Movement in the labeling head 12 is supported by the shafts and is effected by a fluid pressure operated actuator 128 which when pressurized to extend causes the tower 50 and hence the labeling head 12 to move towards the right. In particular, the actuator 128 is fixed to the tower 50 and includes an actuating rod **128*c*. The actuating rod 128*c* extends through a bore 118 defined by the tower 50. The end of the rod 128*c* is attached to the support member 126 so that extension of the rod pushes the tower 50 away from the support member 126. At the conclusion of a labeling cycle, the actuator 128 is retracted in order to move the tower 50 towards the vertical support member 126**.

Turning now to FIG. 3, the sequence of motion to apply a label to the container 14 is shown. The label wrapping actuator 92 is pressurized to extend the actuating rod **92*c* moving the yoke 90 towards the can 14 (to the position shown in phantom in FIG. 3 and indicated by the reference character 90'). This movement of the yoke 90 causes the arms 70, 72 to move towards each other along an arcuate path designated by the arrows 160, 162. For large containers, such as shown in FIG. 3, the actuator 92 extends until contact between the distal ends of the arms 70, 72 and the container 14 occur. In this position, the label to be applied is clamped between the elastic belt 82 and a periphery 14*a* of the container 14. Adhesive (not shown) carried by the label (as applied by the gluing attachment) causes the label to adhere to the wall of the container. The vacuum source is de-energized or alternately disconnected from the label holding/pick up member 96 and consequently, the label is released. The label wrapping actuator 92 is then retracted in order to open the arms 70, 72 and move them to the fully retracted position. The tower positioning actuator 128 is retracted to return the tower to the retracted position at which the tower 50 is adjacent the support 126. The labeling head 12 is then rotated by the swing actuator 52 to the label receiving position i.e., to the position at which the elastic belt 82 is in confronting relation with the support conveyor 10. This cycle is continually repeated to apply labels in succession, to containers presented to the labeling head 12**.

The containers 14 may be moved sequentially along a conveyor to a predetermined position which is aligned with the labeling head 12. The sequence of operation may be activated by an operator manually or alternately the labeling head 12 may be automatically cycled when a container reaches a predetermined, aligned position.

Figure 4:
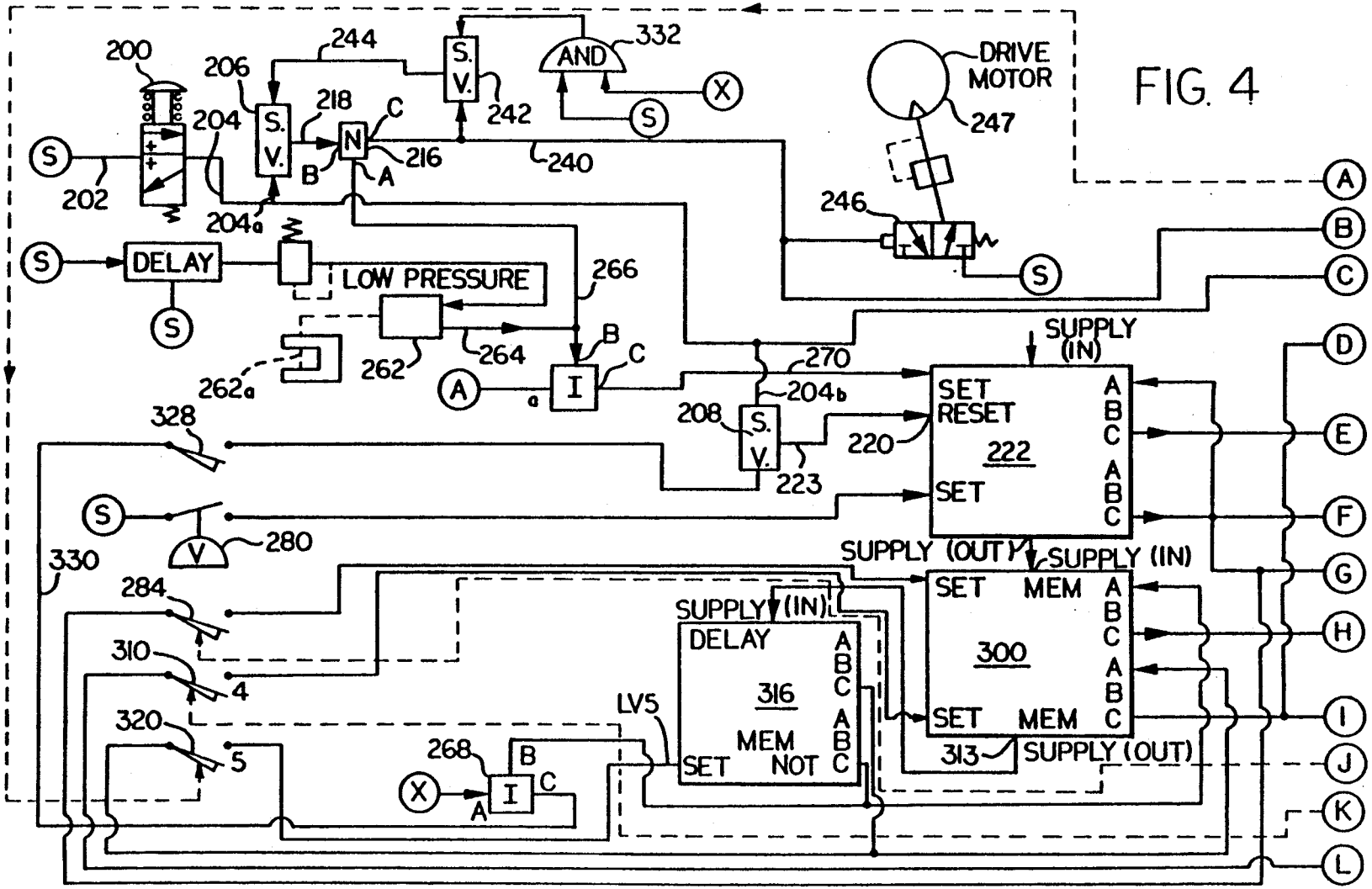

In the disclosed embodiment, the conveyor drive motor as well as the various actuators are all pneumatically operated and controlled by a pneumatic circuit shown in FIG. 4. With the disclosed control system, the labeling apparatus can be used in an explosive atmosphere since the source of ignition is minimized as compared to electrically operated machines.

It should be understood that other drive mechanisms and control systems are contemplated by the present invention. For example the drive motors may comprise electric motors if the environment in which the machine is to be used allows such equipment. A suitable electrical control system would be used to control the motors. The drive motors and control system can also be hydraulic or combination of electrical/electronic and hydraulic.

Turning now to FIG. 4, the labeling machine is activated by the momentary actuation of a spring loaded valve 200 which is operative to momentarily connect a supply line 202 with a feed line 204. The feed line 204 is connected to one end of a shuttle valve 206 by way of a branch line 204*a*. The momentary pressure signal generated by the operation of the valve 200 is also applied to another shuttle valve 208 via branch conduit 204*b*, a shuttle valve 210 via branch conduit 204*c* and a fourth shuttle valve 212.

The shuttle valves which are available from the Aro Corporation of Bryan, Ohio, operate as three way valves with two inlet ports and one outlet port. In particular, a feed line extending centrally from each of the shuttle valves is communicated with one of the two conduits shown connected at opposite ends of the valve. The conduit with the higher pressure is automatically communicated with the center conduit.

As a result, when the palm/push button valve 200 is depressed, pressure is communicated to a "NOT" element 216 via the branch line 204*a*, the shuttle valve 206 and a feed line 218. The signal in the conduit 204 is also communicated to a reset port 220 of a sequencer 222 via conduit 204*b*, shuttle valve 208 and feed line 223. The initial start signal is also applied to a wrap supply control valve 226 via the branch line 204*c*, the shuttle valve 210 and feed line 225. The start signal urges the wrap supply valve 226 to the position illustrated in FIG. 4 at which an air supply S is communicated to a wrap cylinder control valve 230. The wrap control valve 230 controls the application of pressure to the label wrap actuator 92 and in particular controls the extension and retraction of an actuating rod 92*c*. Finally, a vacuum control valve 234 for controlling the operation of an air motor 235 attached to a vacuum pump (not shown), is urged to the position shown in FIG. 4 by the signal conveyed via the shuttle valve 212 at which the air supply S for the vacuum air motor 235 is isolated.

The "NOT" element 216 which is also available from The Aro Corporation, generates an output at a port labeled C whenever a signal is applied by the conduit 218 to a port B and in the absence of a signal at a port A (to which a conduit to be described is connected). At the initial startup, the port A is depressurized and thus, an output signal is generated at the port C and is communicated to a conduit 240. This signal is conveyed to the opposite end of the shuttle valve 206 by a shuttle valve 242 and feedback conduit 244. In effect, a "latching" circuit is formed which maintains an output signal at the port C of the NOT element 216 after the momentary valve 200 is released.

The signal in the conduit 240 is also applied to a drive motor control valve 246 which shifts the valve towards the right and communicates the air supply S with the label machine drive motor 32. This same signal is applied to an "AND" element 246.

In the disclosed machine, the label applying sequence is initiated by activating a label feeder (not shown) in order to feed a label from a label supply. The label feeder may take various forms. In general, the feeder supports a stack of labels to be fed. A pickup mechanism or friction feed mechanism advances the top label onto a delivery conveyor which carries the label through a glue applying unit and then delivers the label onto the conveyor 10 (which is driven by the drive motor 32).

In the illustrated embodiment, the label feed mechanism includes a pusher foot (not shown) that frictionally engages the top label and pushes into a nip roll assembly (not shown). The nip roll assembly advances the label through a gluer (not shown) and into a second nip roll assembly which in turn advances the label onto the conveyor 10. The pusher foot is operated and, in particular, reciprocated by a label feed actuator 250.

The label feed actuator 250 is extended whenever a foot operated, spring biased valve 252 is actuated. In particular, depression of the foot valve 252 communicates supply pressure S to a label feeder control valve 256 via shuttle valve 254. When the label feeder control valve 256 is shifted to the right in response to pressure communicated from the shuttle valve 254, supply pressure is communicated to a head end 250*a* of the label feed actuator 250 (via conduit 257) causing extension of an actuating rod 258. When the actuating rod 258 fully extends or alternately extends to a predetermined limit, a limit switch 260 is actuated which communicates supply pressure S to the label feeder control valve 256 and shifts it to the right, thus communicating supply pressure S to a rod end 250*b* of the actuator 250 thereby retracting the actuating rod 258.

After a label has been fed from the label supply, the delivery system and conveyor 10 ultimately convey the label to a label presenting position on the conveyor 10 at which the label applying head 12 can grip and pickup the label. The arrival of a label at the label presenting position is sensed by a pneumatic sensor, indicated schematically by the reference character 262 (shown also in FIG. 2) which includes an air stream 262*a* that is interrupted by a properly positioned label. The sensor itself is commercially available from The Aro Corporation. When a label is detected by the sensor 262, the sensor outputs a pressure signal along a conduit 264 which in turn is concurrently communicated via conduit 266 to the "A" port of the "NOT" element 216 and a "B" port of an "inhibitor" element 268 which is a pneumatic device also available from The Aro Corporation.

At initial machine start up as will be clarified further on, the presence of a signal at the "B" port of the inhibitor 268 will produce an output at its "C" port. This pressure signal is conveyed along a conduit 270 to the "SET" port of a pneumatic sequencer, which in the illustrated embodiment is available from The Aro Corporation and identified as a model number 59897. The application of the signal at the "SET" port initiates the labelling procedure. The sequencer operates such that the presence of a signal at the "SET" port produces an output signal at the "C" port as long as there is no signal at the "A" port.

At initial start up no signal is present at the "A" port and therefore an output signal is generated at the "C" port which is applied to the wrap supply control valve 226 shifting it to the right (as viewed in FIG. 4). This shifting interrupts the air supply to the wrap control valve 230 and a result a rod end of the wrap actuator 92 is depressurized allowing the wrap cylinder to extend under the weight of the operating arms 70,72. In short, the label applying arms 70, 72 droop downwardly when the wrap actuator 230 is depressurized allowing the vacuum pickup 96 (shown in FIGS. 1–3) to contact the label supported by the conveyor 10.

The signal pressure applied to the wrap supply control valve 226, is concurrently applied to the vacuum control valve 234 and shifts it to the right (as viewed in FIG. 4) thereby communicating a supply of air to the air motor driving a vacuum pump connected to the pickup tube 96. A vacuum begins to develop in the label pickup 96 if the pickup tube contacts the label. The vacuum level is monitored by a vacuum switch 280 and when a predetermined level is sensed, the switch is closed thereby communicating a pressure signal to a second "SET" port on the sequencer 222. The presence of a signal at the "SET" port generates an output pressure at the associated "C" port which shifts the wrap supply valve 226 to the left by way of the shuttle valve 210. The shifting of the wrap supply valve 226 causes the supply pressure S to be applied to the rod end **92*b* of the wrap actuator 92 (via the wrap actuator control valve 230) which causes the wrap actuator 92 to retract thereby raising the label applying arms 70, 72 and the label held by the label pickup tube 96. At the same time, the signal pressure from the lower "C" port of the sequencer 222** is applied to its upper "A" port thereby disabling the output at the associated, upper "C" port which enables the wrap supply valve to be shifted to the left.

The signal at the lower "C" port is also communicated to a position control valve 282 which shifts the valve to the right thus communicating the supply pressure S to a rod end **52*b* of the head positioning/swing actuator 52 causing the actuating rod 66 to retract. When it reaches the fully retracted position or alternately a predetermined retracted position, a limit valve 284 is actuated which communicates the signal pressure from the lower "C" port of the sequencer 222 to the "SET" port of a second sequencer 300. The sequencer 300 is available from The Aro Corporation and is designated as a model 59898. The signal applied to the "SET" port produces an output signal at the upper "C" port of the sequencer 300 which shifts a spring biased, extend control valve 302 to the right (as viewed in FIG. 4) and communicates the supply pressure S to a head end of the extend actuator 128. The supply pressure S (communicated to the head end 128*a* of the extend actuator 128) is also applied to the "A" port of an inhibitor element 306 (also available from The Aro Corporation). The inhibitor operates such that the presence of a signal pressure at its "A" port inhibits the output of a signal pressure at its "C" port regardless of the status of the its "B" port. When the extend actuator 128 reaches a fully extended position or alternately to a predetermined extended position, an extension sensor 310 operates and causes a signal pressure to be applied to a second (lower, as viewed in FIG. 4) "SET" port of the sequencer 300. The presence of this signal produces an output signal at the lower "C" port of the sequencer 300 which is communicated to the wrap control valve 230, shifting it to the right (as viewed in FIG. 4) causing the supply pressure S to be applied to the head end 92*a* of the wrap actuator 92 which in turn causes the support arms 70, 72 of the labeling head 12 to move towards the can 14 (shown in FIG. 3) being labelled and in effect causes the elastic, label support belt 82 to wrap around the outer circumference of the can 14. The signal pressure generated at the lower "C" port of the sequencer 300 is also applied to the vacuum control valve 234 via the shuttle valve 212 and shifts the control valve to the left thus terminating the communication of the supply pressure S to the air motor 235. An adjustable flow restriction 312 is preferable placed in the conduit feeding the vacuum control valve 234 so that the actual shifting of the valve can be adjustably delayed. The delay in shifting the valve 234 prolongs the engagement of the label by the pickup tube 96 so that the label is held by both the pickup tube 96 and support belt 82 for at least a portion of the time the can 14 is being engaged by the support belt 82. With this arrangement, the label is released by the pickup tube 96 after the support belt 82** has been in wrapping contact with the can being labelled for a predetermined time.

In addition to the output signal at the lower "C" port, a signal pressure is also generated at the "supply-out" port 313 of the sequencer 300 whenever the lower "SET" port is pressurized. This "supply-out" signal is communicated to a third sequencer 316 which is available from The Aro Corporation and designated as a model 59900. The sequencer includes a delay circuit which produces a signal at its upper "C" port a predetermined time after a "supply-in" port 315 of the sequencer 316 is pressurized by the signal from the "supply-out" port 313 of the sequencer 300.

The delay time is adjustable. After the predetermined delay, the upper "C" port of the sequencer 316 produces an output signal which is fed to the lower "A" port of the sequencer 300. The application of a signal to this "A" port terminates the output signal at the lower "C" port of the sequencer 300 (which communicates with the wrap control valve 230). Termination of pressure to the wrap control valve 230 enables the valve to shift to the left under the influence of the biasing spring and causes the supply pressure S to be communicated to the rod end **92*b* of the wrap actuator 92 thus retracting the actuating rod 92*c* and hence the belt support arms 70, 72**.

When the arms 70, 72 fully retract or alternately reach a predetermined retracted position, a limit switch 320 is actuated which communicates a signal pressure to the "SET" port of the sequencer 316. This produces an output signal pressure at the "C" port of the sequencer 316 that is communicated to the upper "A" port of the sequencer 300 thus disabling the signal at its upper "C" port. The termination of the signal at the upper "C" port allows the extension control valve 302 to shift to the left under the influence of the biasing spring thus communicating the supply pressure S to the rod end **128*b* of the extend actuator 128 and causing the tower 50 to move rearwardly away from the can 14. This signal pressure at the "C" port of the sequencer 316 is also applied to a "B" port of the inhibitor 268 and since the extend control valve 302 shifts and terminates the supply pressure to the head end 128*a* of the actuator 128**, the signal pressure to the "A" port of the inhibitor 268 (communicated via the conduit connection "X") is terminated. The lack of a signal at the port "A" coupled with the application of a signal at the port "B" cause the inhibitor 268 to produce an output signal pressure at its port "C". This inhibitor generated signal communicates with a can "in place" detector 328 via a conduit 330. If a can is in position for labelling, the switch 328 is closed and a signal pressure is communicated to a "RESET" port of the sequencer 222 through the shuttle valve 208 which restarts the entire labelling sequence.

The pressure applied to the head end 128*a* of the extend actuator 128 is also applied to an AND gate 332 (via conduit connection "X") which causes a signal pressure to be applied to the NOT element 216 via the shuttle valve 242, the conduit 244, the shuttle valve 206 and the conduit 218. As long as a label is not being detected by the detector 262, the NOT element 216 produces an output at its port "C" which is directed along the conduit 240. This signal pressure shifts the drive control valve 246 to the left, reactivating the drive motor 32 and hence the main conveyor 10.

If a can is waiting to advance to the label applying position, a "next can" switch 336 is closed which applies a signal pressure (from the extend control valve 302 via conduit 338) to the AND gate 246. The presence of a signal at both inputs to the AND gate 246 (via the "next can" switch and the conduit 240) generates an output which in turn causes a momentary output signal to be generated by a "1 shot" control element 240. This momentary signal causes the label feeder control valve 256 to shift to the left causing the supply pressure S to be communicated to the rod end 250*a* of the label feed actuator causing the feed mechanism to advance a label from the label supply.

With the disclosed arrangement, a label can be fed to the label presenting position on the conveyor 10 while the label applying head 12 is applying a label to a can at the label applying station. As a result, increased productivity is realized since the system does not have to wait for the label applying cycle to be completed before another label is fed to the label presenting position on the support conveyor.

Although the invention has been described with a certain degree of particularity it should be understood that those skilled in the art can make various changes to it without departing from the spirit or scope of the invention as hereinafter claimed.

For example, the present invention contemplates other arrangements for positioning the label at the label presenting position. It should not be limited to the conveyor 10. Apparatus for maintaining a stack of labels below the label presenting position is also encompassed by the present invention, which would eliminate the need for a transfer conveyor. In addition, an arrangement in which a label to be applied is pulled from a label supply in the form of a roll of labels in also contemplated.

The present invention also contemplates other label gluing arrangements such as self adhesive labels and devices for spraying adhesive onto the label or onto the container itself.

We claim:

1. A labeling apparatus for applying labels to containers or the like, comprising:

a) means for positioning a label to be applied at a label presenting position;

b) a label applying head operative to receive a label from the positioning means and further operative to move the label to a label applying position at which said label is clamped into abutting engagement with a container;

c) said label applying head moveable between a label receiving position and a label applying position and including a pair of moveable supports and an elastic belt supported between portions of said supports, each of said supports including another portion spaced longitudinally from said one portion, said other portions mounted for movement about a substantially common pivot means such that as said supports move about said substantially common pivot means, said one portions of said supports move towards and away from each other along a predetermined path;

d) actuating means for moving said one support portions between a retracted position at which said one support portions are spaced apart by a first predetermined distance and an extended position at which said one support portions are spaced apart by a second predetermined distance less than said first predetermined distance;

e) label holding means for holding a label to said label applying head including an elastic member defining apertures and a source of sub-atmospheric pressure for creating suction at said apertures by which a label is attracted and held to the labeling head.

2. The apparatus of claim 1 wherein said positioning means comprises a transfer conveyor.

3. The apparatus of claim 1 wherein said supports comprise a pair of pivotally mounted arms and said portions supporting said belt comprise distal ends of said arms.

4. The apparatus of claim 1 further comprising a mechanism for rotatably moving said label applying head between said label receiving position and said label applying position.

5. The labeling apparatus of claim 1 wherein said predetermined path along which said support portions move is generally arcuate.

6. A labeling apparatus for applying labels to containers or the like, comprising:

a) a transfer conveyor for transporting a label to be applied to a label presenting position;

b) a label applying head operative to receive a label from the transfer conveyor and further operative to move the label to a label applying position at which said label is clamped into abutting engagement with a container;

c) said label applying head rotatable between a label receiving position and a label applying position and including a pair of elongate arms and an elastic belt supported between distal ends of said arms, each of said arms including a portion spaced longitudinally from said distal end, said portions of said arms mounted for movement about a substantially common pivot means such that as said arms move about said substantially common pivot means, said distal ends of said arms move toward and away from each other along a predetermined arcuate path;

d) actuating means for moving said arms between a retracted position at which said distal ends of said arms are spaced apart by a first predetermined distance and an extended position at which said distal ends of said arms are spaced apart by a second predetermined distance less than said first predetermined distance;

e) label holding means for holding a label to said label applying head including an elastic member defining apertures and a source of sub-atmospheric pressure for creating suction at said apertures by which a label is attracted and held to the labeling head.

7. The apparatus of claim 6 wherein said label applying position of said label applying head is adjustable to accommodate containers of various configurations.

8. The apparatus of claim 6 wherein said transfer conveyor includes at least one support belt and a pinch roll frictionally driven by said support belts.

9. The apparatus of claim 6 wherein said actuating means for moving said arms includes a fluid pressure operated actuator and a yoke assembly operatively connected with said arms such that extension and retraction of said actuator reciprocates the arms between said retracted position and said extended position.

10. The apparatus of claim 6 further comprising a fluid pressure operator control system for controlling movement in said label applying head, said transfer conveyor and said actuating means.

11. The apparatus of claim 6 wherein said transfer conveyor is driven by a fluid pressure operated motor.

12. The apparatus of claim 10 further comprising a vacuum sensing means operative to monitor a vacuum level in said holding means and further operative to activate a swing actuator for rotating said label applying head to said label applying position upon sensing a predetermined level of vacuum in said holding means.

13. The apparatus of claim 6 including support means for supporting rectilinear, transverse movement in said label applying head.

14. The apparatus of claim 12 wherein said fluid pressure operated swing actuator is interconnected with said label applying head by a rack and gear arrangement such that reciprocation of said actuator produces rotation and counter-rotation in said label applying head.

15. The apparatus of claim 6 wherein said label applying head is rotated by a fluid pressure operated swing actuator interconnected with said head by a rack and gear arrangement such that reciprocation of said actuator produces rotation and counter-rotation in said label applying head.

16. The apparatus of claim 6 wherein said arms are arcuate in configuration such that when said apparatus is used to apply labels to cylindrical containers, said arms tend to encircle said cylindrical container as said arms move to an extended position, whereby said elastic belt engages said container and tends to smooth out the label being applied.

17. A labeling apparatus for applying labels to containers or the like, comprising:

a) a transfer conveyor for transporting a label to be applied to a label presenting position;

b) a label applying head operative to receive a label from the transfer conveyor and further operative to move the label to a label applying position at which said label is clamped into abutting engagement with a container;

c) said label applying head rotatable between a label receiving position and a label applying position and including a pair of pivotally mounted arms and an elastic belt supported between distal ends of said arms;

d) actuating means for moving said arms between a retracted position and an extended position;

e) label holding means for holding a label to said label applying head including an elastic member means defining apertures and a source of sub-atmospheric pressure for creating suction at said apertures by which a label is attracted and held to the labeling head, said elastic member means of said label holding means comprising one or more elastomeric tube-like elements which are mounted coextensive with said elastic label support belt.

18. The apparatus of claim 17 including support means for supporting rectilinear, transverse movement in said label applying head.

19. A labeling apparatus, comprising:

a) a horizontal transfer conveyor for transporting a label to be applied from a label feeder means to a label presenting position;

b) sensing means for sensing the arrival of a label at a label presenting position on said conveyor.

c) a label applying head rotatable about a transverse axis including a label pickup member operative to engage a label on said transfer conveyor, when said label is at said label presenting position, said labeling head rotatable to a label applying position at which said label is driven into abutting engagement with a container to be labeled;

d) a fluid pressure operated swing actuator for rotating said label applying head between a label receiving position and a label applying position, said head including a pair of pivotally mounted arms and an elastic, label support belt extending between distal ends of said arms;

e) a belt wrapping actuator for moving said arms between a retracted position and an extended position; and, f) fluid pressure operated control system for controlling movement in said wrapping actuator and said swing actuator, and g) said label pickup member comprising an elongate, elastomeric tube extending along one edge of said elastic belt and defining a plurality of apertures extending through a planar surface, said planar surface being substantially parallel a surface defined by said elastic support belt.

20. The apparatus of claim 19 further comprising a source of vacuum, controlled by said fluid pressure operated control system, said control system operative to communicate a source of subatmospheric pressure to said pickup member when said head is rotated to a label receiving position and a label is at the label presenting position on said conveyor.

21. The apparatus of claim 20 wherein said sensor forms part of said fluid pressure operated control system.

22. A labeling apparatus, comprising:

a) a horizontal transfer conveyor for transporting a label to be applied from a label feeder means to a label presenting position;

b) sensing means for sensing the arrival of a label at a label presenting position on said conveyor.

c) a label applying head rotatable about a transverse axis including a label pickup member operative to engage a label on said transfer conveyor, when said label is at said label presenting position, said labeling head rotatable to a label applying position at which said label is driven into abutting engagement with a container to be labeled;

d) a fluid pressure operated swing actuator for rotating said label applying head between a label receiving position and a label applying position, said head including a pair of elongate arms and an elastic, label support belt extending between distal ends of said arms, each of said arms including a portion spaced longitudinally from said distal end, said portions of said arms mounted for movement about a substantially common pivot means such that as said arms move about said substantially common pivot means, said distal ends of said arms move toward and away from each other along a predetermined arcuate path;

e) a belt wrapping actuator for moving said arms between a retracted position at which said distal ends of said arms are spaced apart by a first predetermined distance and an extended position at which said distal ends of said arms are spaced apart by a second predetermined distance less than said first predetermined distance;

f) fluid pressure operated control system for controlling movement in said wrapping actuator and said swing actuator.

23. The apparatus of claim 22 wherein said label applying head is mounted for reciprocating, transverse movement with respect to a stationary frame member forming part of said labeling apparatus and said apparatus further includes a slide arrangement mounted to said frame member and a fluid pressure operated extension actuator mounted to said label applying head for moving said head towards and away from said frame member.

24. The apparatus of claim 22 wherein said swing actuator includes an actuating member, the range of movement of which is adjustable to adjust the label applying position of said label applying head.

25. The apparatus of claim 24 wherein said actuating member comprises a rack operatively attached to said swing actuator and a rack gear forming part of said label applying head and operatively interconnected with said rack such that reciprocation of said swing actuator produces rotative movement in said head.

26. The apparatus of claim 22 wherein said label pickup member is communicated with a source of vacuum until said label support belt is driven into wrapping engagement with a container.

27. The apparatus of claim 22 wherein said label pickup member is communicated with a source of vacuum for a predetermined time after said support belt is driven into wrapping engagement with a container.

28. The apparatus of claim 22 wherein said arms tend to encircle a container being labeled whereby said label support belt engages said container and smoothes out the label being applied.

29. The apparatus of claim 22 wherein said substantially common pivot means comprises a pivot assembly defining a common pivot axis for said arm portions.

30. A labeling apparatus, comprising:

a) a horizontal transfer conveyor for transporting a label to be applied from a label feeder means to a label presenting position;

b) sensing means for sensing the arrival of a label at a label presenting position on said conveyor;

c) a label applying head rotatable about a transverse axis including a label pickup member operative to engage a label on said transfer conveyor, when said label is at said label presenting position, said labeling head rotatable to a label applying position at which said label is driven into abutting engagement with a container to be labeled;

d) a fluid pressure operated swing actuator for rotating said label applying head between a label receiving position and a label applying position, said head including a pair of pivotally mounted arms and an elastic, label support belt extending between distal ends of said arms;

e) a belt wrapping actuator for moving said arms between a retracted position and an extended position;

f) fluid pressure operated control system for controlling movement in said wrapping actuator and said swing actuator;

g) means for communicating said label pickup member with a source of vacuum for a predetermined time after said support belt is driven into wrapping engagement with a container; and, h) operator adjustment means for enabling an operator to adjust said predetermined time.

31. A labeling apparatus, comprising:

a) a horizontal transfer conveyor for transporting a label to be applied from a label feeder means to a label presenting position;

b) sensing means for sensing the arrival of a label at a label presenting position on said conveyor.

c) a label applying head rotatable about a transverse axis including a label pickup member operative to engage a label on said transfer conveyor, when said label is at said label presenting position, said labeling head rotatable to a label applying position at which said label is driven into abutting engagement with a container to be labeled;

d) a fluid pressure operated swing actuator for rotating said label applying head between a label receiving position and a label applying position, said head including a pair of pivotally mounted arms and an elastic, label support belt extending between distal ends of said arms;

e) a belt wrapping actuator for moving said arms between a retracted position and an extended position;

f) fluid pressure operated control system for controlling movement in said wrapping actuator and said swing actuator;

g) a rack operatively attached to said swing actuator and h) a rack gear forming part of said label applying head and operatively interconnected with said rack such that reciprocation of said swing actuator produces rotative movement in said head; and, i) adjustment means for adjusting the label applying position of said label applying head including mechanical stops that block movement in said rack or rack gear when said head reaches the desired label applying position.

* * * * *